US007008143B1

(12) United States Patent
Wolfe

(10) Patent No.: US 7,008,143 B1
(45) Date of Patent: Mar. 7, 2006

(54) MODIFIED ANGLED SILT FENCE

(75) Inventor: Kevin B. Wolfe, Nashville, TN (US)

(73) Assignee: Civil & Environmental Consultants, Inc., Nashville, TN (US)

( * ) Notice: Subject to any disclaimer, the term of this patent is extended or adjusted under 35 U.S.C. 154(b) by 70 days.

(21) Appl. No.: 10/780,787

(22) Filed: Feb. 18, 2004

(51) Int. Cl.
*E02D 17/20* (2006.01)

(52) U.S. Cl. ..... 405/302.6; 405/302.7

(58) Field of Classification Search ..... 405/302.7, 405/302.6, 302.4, 115, 114, 107, 35, 34, 33, 405/15, 21
See application file for complete search history.

(56) References Cited

U.S. PATENT DOCUMENTS

| | | | | |
|---|---|---|---|---|
| 898,984 | A | 9/1908 | McFarlane | |
| 4,136,995 | A | 1/1979 | Fish | 405/115 |
| 4,511,286 | A | 4/1985 | Hardacre | 405/115 |
| 4,549,724 | A | 10/1985 | Taillandier | 256/12.5 |
| 4,921,373 | A | 5/1990 | Coffey | 405/115 |
| 5,039,250 | A | 8/1991 | Janz | 405/15 |
| 5,405,217 | A * | 4/1995 | Dias et al. | 405/302.6 |
| 5,605,416 | A * | 2/1997 | Roach | 405/21 |
| 6,109,835 | A * | 8/2000 | Grabhorn | 405/302.6 |
| 6,497,532 | B1 * | 12/2002 | McGinn | 405/33 |
| 6,616,383 | B1 * | 9/2003 | Janz | 405/302.7 |
| 6,692,188 | B1 * | 2/2004 | Walker et al. | 405/115 |
| 6,709,202 | B1 * | 3/2004 | Spangler et al. | 405/302.6 |

* cited by examiner

*Primary Examiner*—Frederick L. Lagman
(74) *Attorney, Agent, or Firm*—Waddey & Patterson, P.C.; Mark J. Patterson; Howard H. Bayless

(57) ABSTRACT

A silt fence includes a support comprising having a rear strut pivotally joined with an articulated front support. A geotextile sheet attaches to the support forming a filtration barrier having compound slope. A lower section is sloped at the first angle sufficiently steep to shed non-colloidal silt. An upper section is sloped at the second slope angle sufficiently shallow so as to expose a proportionally greater barrier surface area to ponded water to increase the water flow capacity for given height of water. Additionally, the second slope angle is sufficiently steep to shed a portion of the non-filtered colloidal silt.

34 Claims, 6 Drawing Sheets

63
34
30
32
20
22
65
42, 41
40
24, 26, 28
45, 41
40
60, 65
62, 66, 52
50, 65
63
70
71
74
75
96
97

24, 26, 28
32
30
44
34
24, 26, 28
46
45, 41
47
40
20
43
82
52
84
88
48
52, 51, 50
54

MODIFIED ANGLED SILT FENCE

BACKGROUND OF THE INVENTION

The present invention relates generally to sediment control barrier systems and relates more particularly to filtration barriers for waterborne silt and to methods and apparatus for installing the silt filtration barriers, of which the following is a specification, reference being had to the accompanying drawing, forming a part hereof.

Sediment control barrier systems have a variety of uses and a wide range of industrial applications. They include: protection of surface soils from surface water erosion, the trapping of sediment, and run-off water filtration for improving water quality, and preventing waterborne silts and solids from entering channeled streams and drainage control systems.

A wide variety of materials and structures are used in sediment control barriers systems and in geo-barrier systems in general. Since terminology is somewhat non-standardized, the following terms are defined herein. The term 'geo-fabric' refers to a geo-textile, geo-membrane or a geo-grid structure, or to a combination of thereof. The term 'geo-textile' refers to a woven, non-woven, or knitted, biodegradable-resistant fabric that is sufficiently porous as to allow movement of air and water. Geo-textiles are typically load-bearing, synthetic fabrics used as a filter to prevent the passing of fine grained material such as silt or clay. The term 'geo-grid' refers to biodegradable-resistant material manufactured into an open, lattice like sheet configuration. Geo-grids are typically made of plastic and used as a reinforcing structure. The term 'geo-membrane' refers to essentially impermeable polymeric sheets. Geo-membranes are typically used as hydraulic barriers in liner and cover systems.

Sediment control barriers include silt fences constructed of filtering fabrics, support posts and wire fences. Silt fences are, typically, single vertical barriers made from a geo-fabric supported in upright position by posts and support mesh. More particularly, typical silt fences are temporary sediment barriers made of woven synthetic filtration fabric supported by steel or wooden posts. Silt fences prevent sediments carried by un-channeled or sheet flow of storm or rainwater from leaving a ground site and either entering natural drainage channels or entering waste and storm drain systems. The barriers slow the runoff sheet flow and frequently create a ponding of water upstream of the silt fence. The reduction in water velocity causes the larger entrained soil particles to settle to the ground surface upstream of the silt fence. A silt fence constructed of permeable geo-textile sheets creates a filtration barrier that filters non-colloidal, suspended silt particles as the low velocity or ponded water passes through the silt fence to form an effluent stream. The filtered silt particles are shed from the vertical fabric barrier surface of the standard silt fence and accumulate at its base. The size of the barrier openings determine the size of the particles filtered. The size, shape and number of the openings, as well as the height of the ponded water, determine the flow rate of the filtered effluent stream.

Un-channeled surface water that is deposited upon ground having a sloped surface flows by gravity directed flow along paths determined by the contour of the ground surface. Typically, a silt fence is installed along a path spanning the sloped ground surface or along a path spanning beneath such a slope. The installation path is selected such that it is transverse to the water flow path and impedes the flow. But, the installation path is not necessarily orthogonal to the direction of runoff water flow at each point along the path.

Since sheet flow run-off is stored upstream of a silt fence, the slope grade and the slope length determine the hydraulic load experienced by the silt fence. A maximum recommended slope length upstream of an installed silt fence is determined based on the mechanical strength of the silt fence assembly, the flow rate through the barrier and the volume of water per unit slope area per unit time expected to be deposited upon the slope.

A standard silt fence assembly consists of a woven geo-textile sheet stapled to a series of long wooden stakes. The typical length of the stakes is 48 inches and the stakes are typically made of a hardwood. The stakes are installed at intervals of from 4 to 6 feet and are driven into the ground along a selected path typically over a contour of the surface transverse to the path of ground water run- fence before the lateral forces of hydraulic load become too much for the system to bear and ultimately cause the silt fence system to collapse.

What is needed then is a silt fence system that can be installed using a shallower embedment depth of the posts while retaining or improving the stability of the silt fence.

Additionally, what is needed is a silt fence assembly which is capable of carrying a greater hydraulic load than the vertical post of the standard silt fence assembly.

An additional need is a silt fence assembly that increases percentage of geo-textile surface area used for filtering while maintaining effective silt shedding characteristics.

BRIEF SUMMARY OF THE INVENTION

A hinged modified angle silt fence support assembly is made from an articulated front strut attached to a rear strut. The lower portion of the rear strut and the lower portion of the articulated front strut are sharpened for ease of installation in the earth. The lower portion of the articulated front strut is attached to an upper portion by a first hinge. The upper portion of the articulated front strut is attached to the rear strut by a second hinge. A geo-textile sheet is attached to both the upper and lower portions of the articulated front strut of multiple such support assemblies to form a modified angle silt fence filtration barrier, wherein the upper portion of the filtration barrier can be installed at a shallower slope angle that the lower portion of the filtration barrier.

When installed, the lower portion of each articulated front strut is driven in the ground at intervals along a terrain contour at a lower slope angle. The upper portion of the articulated front strut is rotated out of alignment with the lower portion to form a second slope angle. The rear strut is embedded in the ground and extends from the ground to provide reinforcing support for the upper portion of the articulated front strut.

The lower portion of the filtration barrier is sufficiently steep so as to shed non-colloidal silt filtered by the lower portion of the barrier. While, the upper portion of the filtration barrier is sufficiently shallow as to expose the intercepted water flow to a sufficiently greater amount of filtration barrier surface, and, thus, increase the water flow capacity of geo-textile sheet. Additionally, the upper portion of the filtration barrier is sufficiently steep so as to shed at least a portion of the non-colloidal silt filtered by the upper portion of the barrier.

The filtration barrier and, thus, the support assembly receives both lateral and vertical forces exerted by the weight of the ponded water and distributes those forces between the rear strut and the lower portions of the articulated front strut so as to more firmly embed the articulated front strut and the rear strut.

Other embodiments of the invention incorporate additional filtration barrier sections and additional support struts to provide multiple compounding of the filtration barrier surface. One embodiment incorporates an upwardly convex filtration barrier surface.

DETAILED DESCRIPTION OF THE INVENTION

Figure 1:
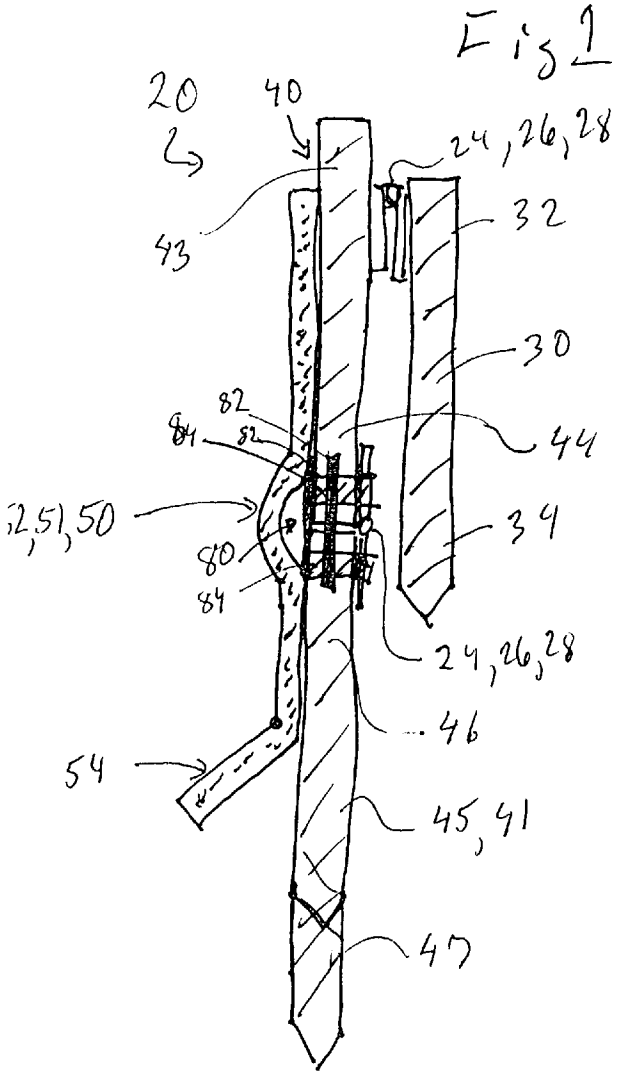
FIG. 1 is a cross-sectional perspective view of one embodiment of a modified angled silt fence adapted to form a barrier having a compound slope angle.

FIG. 1 shows a cross-sectional view of one embodiment of a filtration barrier assembly 10 of this invention. A support assembly 20 is shown including a rear strut 30, the rear strut 30 having a rear strut upper end 32 and a rear strut lower end 34. The support assembly 20 also includes an articulated front support 40 constructed from multiple front struts 41 including an upper front strut 42 and a lower front strut 45. In this embodiment, an upper front strut 42 and a lower front strut 45 are shown as forming the articulated front support 40. The upper front strut 42 is shown having an upper front strut upper end 43 and an upper front strut lower end 44. The lower front strut 45 is shown having a lower front strut upper end 46 and lower front strut lower end 47.

The struts of support assembly 20 are connected with flexible joints 26. In this embodiment, the rear strut upper end 32 is connected to the upper front strut upper end 43 with a pivoting joint 28. The upper front strut lower end 44 is also connected to the lower front strut upper end 46 with a pivoting joint 28. In this embodiment, the pivoting joints 28 are hinge joints 24.

A temporary, removable reinforcing assembly 80 is attached across the pivoting joint 28 of the articulated front support 40. Removable splints 82 are placed across the pivoting joint 28 adjacent to the upper front strut lower end 44 and lower front strut upper end 46. A tape wrap 84 affixes the splints 82 to the articulated front support 40 so that linear alignment of the lower front strut 45 and upper front strut 42 is maintained during installation of the lower front strut 45 into the ground surface 93.

Figure 2:
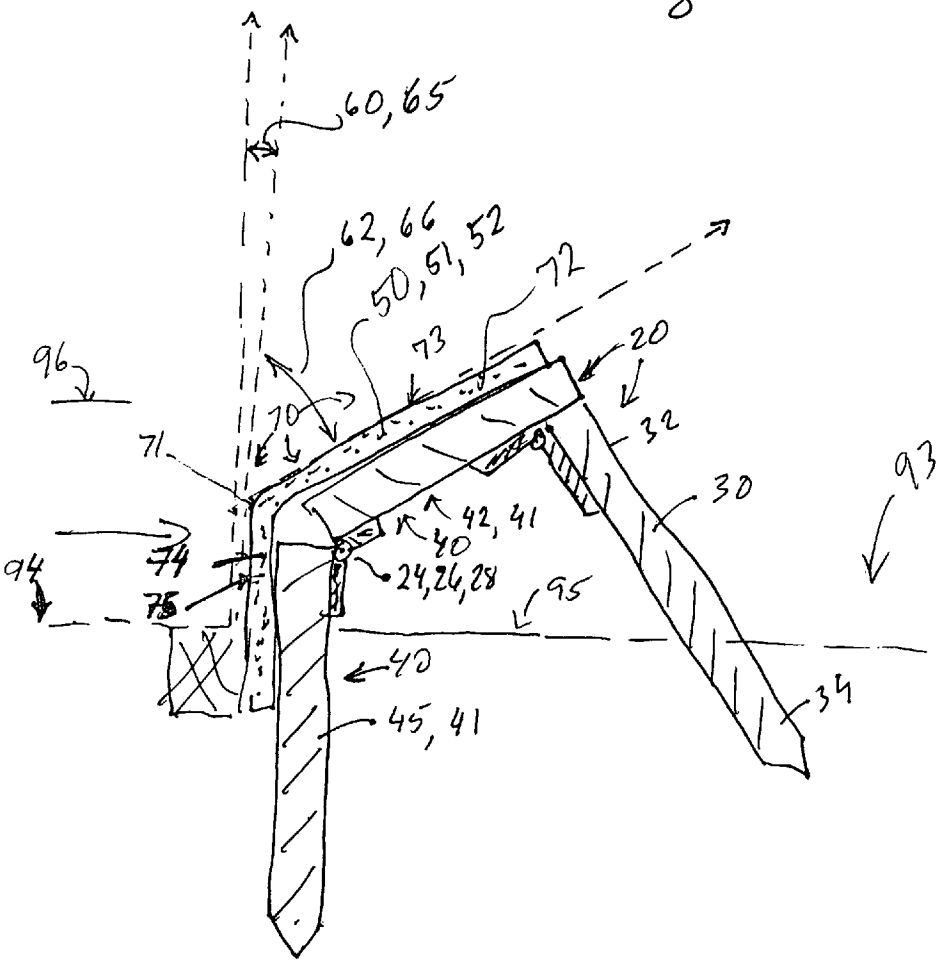
FIG. 2 is a cross-sectional perspective view of the embodiment shown in FIG. 1 in an installed condition.

The support assembly 20 is adapted for installation into a ground surface 93. Although installable at normal silt fence embedment depths, the invention accommodates shallower than normal embedment depths of either or both the articulated front support 40 and rear strut 30 while retaining or improving the stability of the support assembly 20. Referring now to FIG. 2, the rear strut lower end 34 and the lower front strut lower end 47 are adapted for embedment into a ground surface. The rear strut 30 is shown embedded in the ground surface 93 in the downstream ground surface area 95. The rear strut 30 extends towards the upstream ground surface area 94 so as to provide reinforcing support for the upper front strut 42 and the articulated front support 40.

Figure 7:
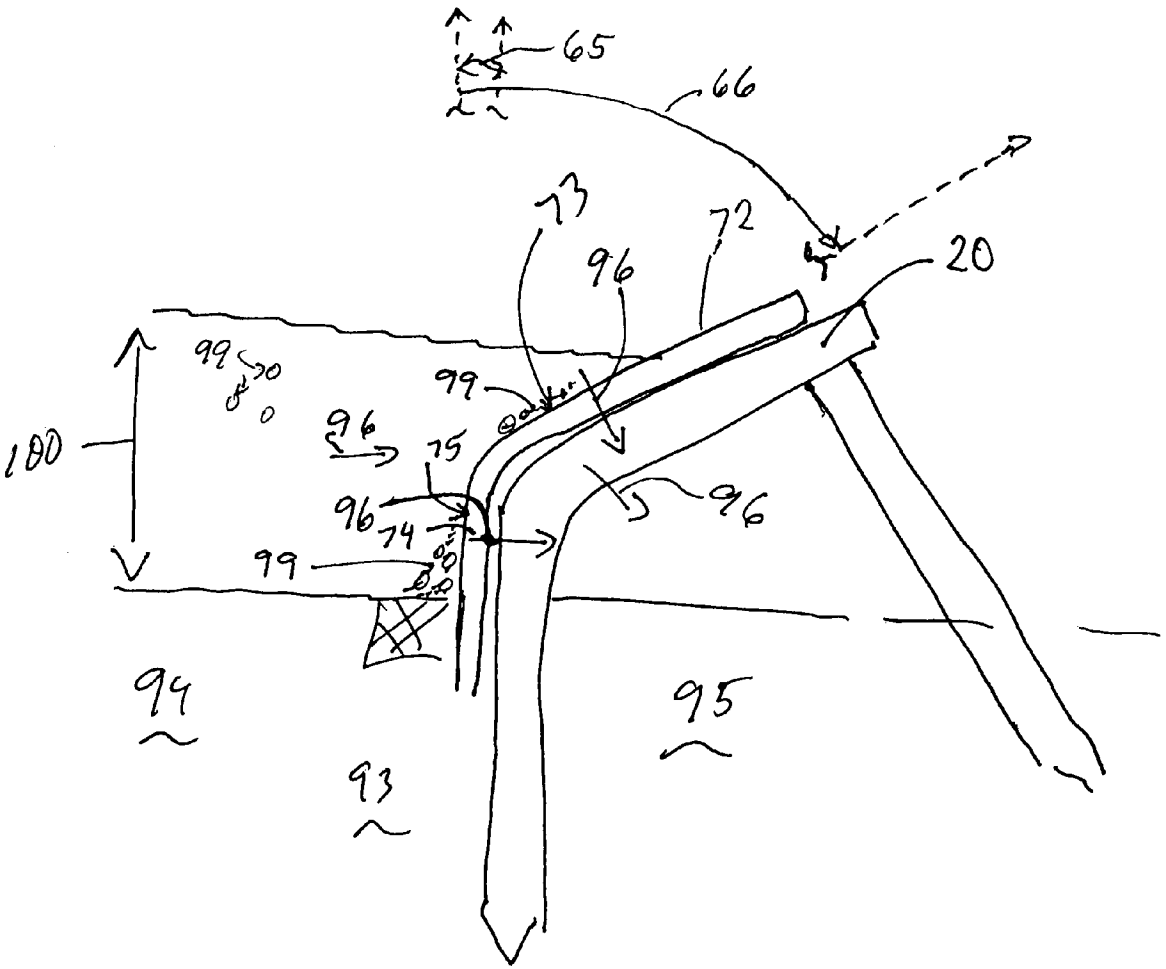
FIG. 7 is a cross-sectional perspective view of the embodiment shown in FIG. 2 having a water flow though the barrier.

Referring now to FIGS. 2 and 7, the weight of the ponded water exerts both lateral and vertical forces upon the filtration barrier 70 and the support assembly 20 of the present invention. The geometry of each installed support assembly 20 distributes any lateral forces impinging the articulated front support 40 between the rear strut 30 and the lower front strut 45. The rear strut lower end 34 and the lower front strut lower end 47 are each subjected to lateral forces determined by various static loading factors, including: the height of the ponded water 100, the angle and depth of embedment of the rear strut lower end 34 and the lower front strut lower end 47, and the angular relationship between the installed struts. Within the normal parameters of installation of the support assembly 20 of this embodiment of the present invention, at least a component of the lateral forces exerted by ponded water acts to force the rear strut lower end 34 further into the ground surface 93 and, thus, more firmly embed the rear strut 30.

If the height of the ponded water reaches a level above the pivoting joint 28 of the articulated front support 40 of this embodiment, the support assembly 20 is subjected to a downward vertical force proportional to the weight of that portion of ponded water flowed above the upper front strut 42. The geometry of the installed support assembly 20 distributes those downward vertical forces between the rear strut lower end 34 and the lower front strut lower end 47. Within the normal parameters of installation of this embodiment of the present invention, at least a component of the downward vertical forces exerted by ponded water above the upper front strut 42 act to force the lower front strut lower end 47 and the rear strut lower end 34 further into the ground surface 93 and, thus, more firmly embed lower front strut 45 and the rear strut 30.

Thus, the present invention provides a silt fence system that can be installed using a shallower embedment depth of the posts while retaining or improving the stability of the silt fence. Additionally, the silt fence assembly of the present invention is capable of carrying a greater hydraulic load than the vertical post of the standard silt fence assembly.

Referring now to FIGS. 1 and 2, the upper front strut 42 and the lower front strut 45 are shown as adapted for receiving a geo-fabric barrier material suitable for forming a filtration barrier 70. FIGS. 1 and 2 show a geo-fabric sheet 50 formed from a geo-textile 51. In this embodiment, the geo-textile 51 is a woven geo-textile 52. The geo-fabric sheet 50 is shown attached to the upper front strut 42 and attached to the lower front strut 45. The geo-fabric sheet 50 has sufficient excess of fabric material at the hinged joint 24 between the upper front strut 42 and the lower front strut 45 to allow for articulation of the hinged joint 24. In alternate embodiments of the present invention, the geo-fabric sheet 50 is formed from a composite of geo-textiles 51 and geo-membrane sheets. In other alternate embodiments, the geo-fabric sheet 50 is formed from a composite of geo-textiles 51 and geo-grids.

Referring again to FIGS. 1 and 2, a ground skirt 54 is attached to the geo-fabric sheet 50 along the lower end of the geo-fabric sheet 50. The ground skirt 54 is comprised of either the same material as the geo-fabric sheet 50 or can be made of a geo-membrane material. The ground skirt 54 can either lie upon the upstream ground surface area 94 in front of the geo-fabric filtration barrier 70 or can be buried in a trench 97 in front of the geo-fabric filtration barrier 70. The ground skirt 54 is positioned so as to prevent the ponded water from freely flowing beneath the silt fence. In alternate embodiments of the present invention the ground skirt 54 is omitted.

FIG. 2 shows an installed filtration barrier assembly 10 including at least two support assemblies 20. (Only one support assembly 20 is shown in this cross-sectional view.) The support assemblies 20 are adapted for installation along a spanning path selected along a contour across a ground surface 93. The spanning path divides the ground surface 93 into an upstream ground surface area 94 in a downstream ground surface area 95, as determined by the direction of water flow 96 over the ground surface 93.

FIG. 2 further shows the support assembly 20 installed upon the ground surface 93. Each support assembly 20 is installed at interval points along the spanning path. The geo-fabric sheet 50 is installed upon the support assemblies 20 so as to form a filtration barrier 70. A lower front strut 45 of an articulated front support 40 is shown embedded in the ground surface 93 at an interval point along the spanning path. The lower front strut 45 is shown extending away from the upstream ground surface area 94 so as to form a first tilt angle 60. Tilt angles are herein defined as the angle formed by a strut and the vertical plane that is tangential to the spanning path at the point of installation of the respective support assembly 20. FIG. 2 also shows the upper front strut 42 further extending away from the upstream ground surface area 94 so as to form a second tilt angle 62. The first tilt angle 60 is the steeper than the second tilt angle 62 angles. Herein, steepness of an angle refers to the comparison of an angle to a vertical angle (a vertical angle being an angle of 0 degrees from the tangential vertical plane). Similarly herein, shallowness of an angle refers to the comparison of an angle to a horizontal angle (a horizontal angle being an angle of 90 degrees from the tangential vertical plane). Unless otherwise stated, all angles correspond to a non-negative slope, wherein a non-negative slope describes a surface that, on average, increases in vertical height as it extends away from the upstream ground surface area 94. FIG. 2 shows the lower front strut 45 embedded in the ground surface 93 so as to form a first tilt angle of between 0 degrees and 45 degrees. FIG. 2 also shows the upper front strut 42 as forming a second tilt angle 62 of between 15 degrees and 65 degrees.

The geo-fabric sheet 50 shown in FIG. 2 is attached to the articulated front support 40 so as to form a filtration barrier 70 having a lower filtration barrier section 74 and an upper filtration barrier section 72. The lower filtration barrier section 74 is sloped at a first slope angle 65. The upper filtration barrier section 72 is sloped at a second slope angle 66. The first slope angle 65 corresponds to the first tilt angle 60 and the second slope angle 66 corresponds to the second tilt angle 62.

Figure 3:
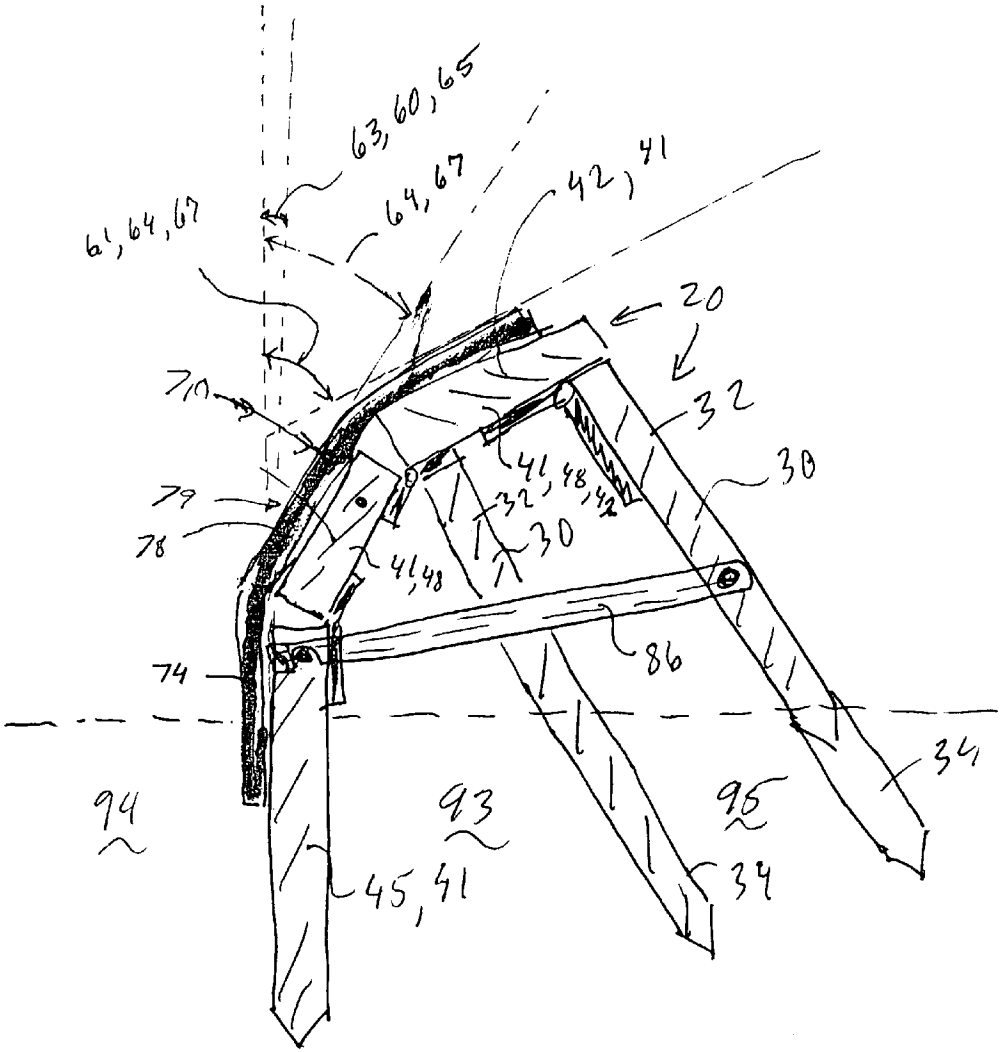
FIG. 3 is a cross-sectional perspective view of an alternative embodiment of a modified angled silt fence adapted to form a barrier having a multiple compound slope angles.

Referring now to FIG. 3, a support assembly 20 is shown including a plurality of front struts 41 assembled in an articulated, linear configuration, wherein each front strut is disposed adjacent to at least one other front strut 41, and wherein each front strut 41 is flexibly attached to each adjacent front strut 41. The articulated front support 40 shown in FIG. 3 includes a lower front strut 45, and two intermediate front struts 48. The intermediate front strut 48 distal to the lower front strut 45 comprises an upper front strut 42 similar to the one shown in FIG. 2. One skilled in the art will recognize that increased curvature of the filtration barrier 70 can be accomplished by increasing the number of intermediate front struts 41 forming a single articulated front support 40. Multiple intermediate front struts 41 form a compound angled filtration barrier surface 71 having a corresponding number of barrier slopes and slope angles.

FIG. 3 further shows multiple rear struts 30 attached at different points to individual front struts 41 forming the articulated front support 40. Each of the installed rear struts 30 are embedded within the ground surface 93 and extended toward the upstream ground surface area 94 so as to provide support for the articulated front support 40 and the filtration barrier 70. Multiple rear struts 30 provide for additional load bearing ability and additional stability for the support assembly 20.

FIG. 3 additionally shows a transverse strut 86 attached to a rear strut 30 and a front strut 41. The transverse strut 86 provides additional rigidity and stability to the support assembly 20. One skilled in the art will recognize that numerous embodiments having transverse struts 86 can be adapted to provide both additional rigidity for the support assembly 20 and easily selectable predetermined geometries for installation of the support assembly 20. Similarly, one skilled in the art will recognize that various combinations of lateral struts (not shown) can be used to rigidly interlink each support assembly 20 to adjacently installed support assemblies 20.

The embodiments of the present invention shown in FIGS. 2 and 3 comprise rigid struts that are not adjustable in length. However, one skilled in the art will recognize that adjustable rigid struts can be substituted for the non- adjustable struts as desired. For example, substitution of an adjustable rear strut for the rear strut 30 of the embodiment of the present invention shown in FIG. 2 will allow for post-installation adjustment of the second tilt angle 62 and, thus the second slope angle 66 of the filtration barrier 70.

FIG. 3 further shows the lower front strut 45 embedded in the ground surface 93 at an interval point along the spanning path. The lower front strut 45 is shown extending away from the upstream ground surface area 94 so as to form a lower tilt angle 63, the lower tilt angle 63 corresponding to the first tilt angle 60 of the embodiment of the present invention shown in FIG. 2. FIG. 3 additionally shows the intermediate front strut 48 extending further away from the upstream area so as to form an intermediate tilt angle 64. FIG. 3 shows the geo-fabric sheet 50 attached to the articulated front support 40 so as to form a filtration barrier 70 having a lower filtration barrier 74 sloped at a first slope angle 65 corresponding to the lower tilt angle 63. FIG. 3 further shows the filtration barrier 70 having an intermediate filtration barrier section 74 sloped at an intermediate slope angle 67 corresponding to the intermediate tilt angle 64.

Figure 4:
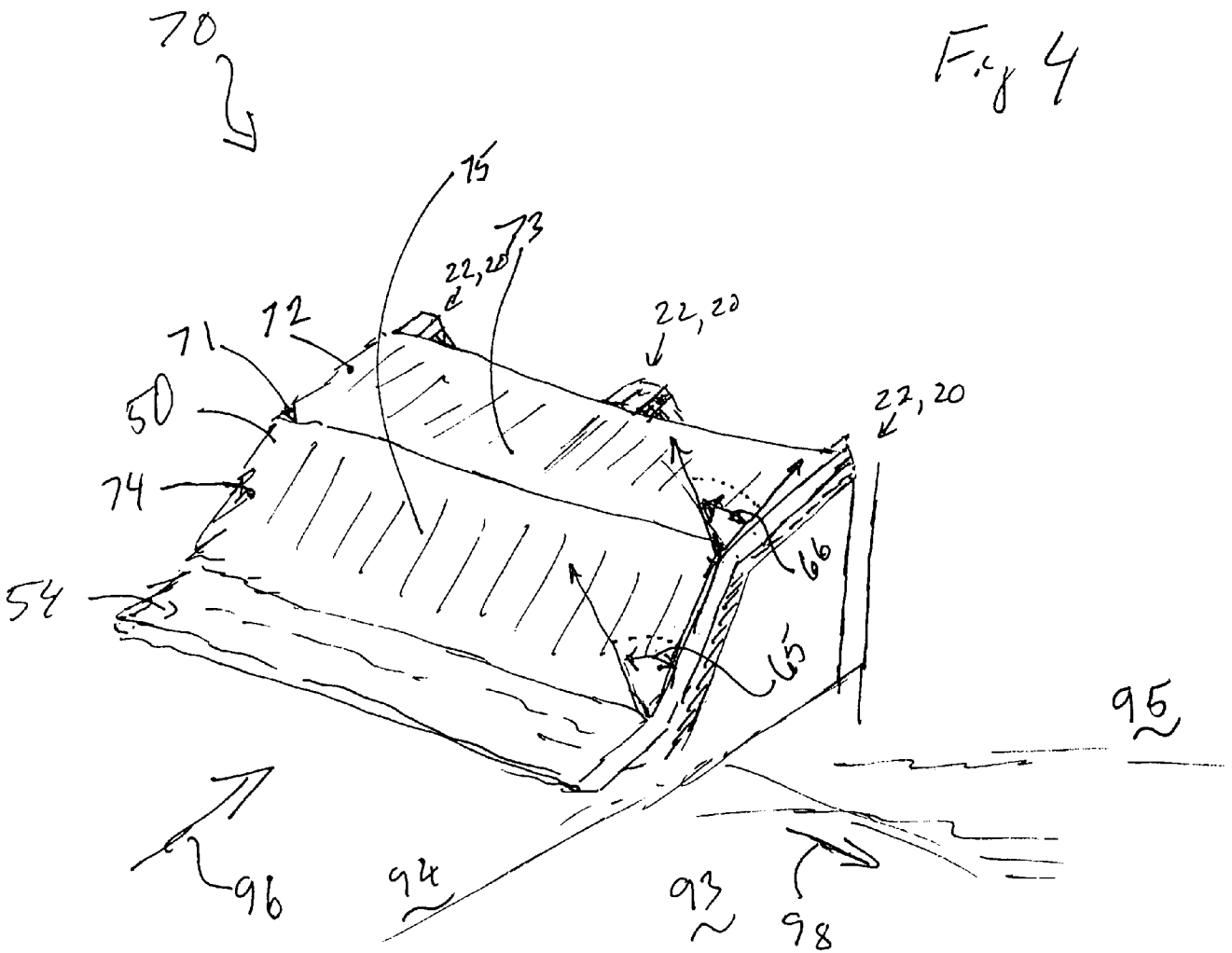
FIG. 4 is an oblique view of the embodiment of the invention of FIG. 2.

Referring now to FIG. 4, an embodiment of the present invention including a filtration barrier 70 is shown installed upon the ground surface 93 along the spanning path 98. The spanning path 98 is transverse but not necessarily orthogonal to the gravity directed water flow 96. The spanning path defines the upstream ground surface area 94 and the downstream ground surface area 95. The filtration barrier 70 includes at least one support frame 22. In this embodiment, the support frames 22 each comprise a support assembly 20. However, other supporting structures may be substituted for the support assembly 20 so long as the desired barrier slope angles are achieved.

Referring again to FIG. 4, the filtration barrier 70 further includes a geo-fabric sheet 50 attached to the support assemblies 20 so as to form a filtration barrier surface 71 for impeding the water flow of the water runoff. The filtration barrier surface 71 is formed so as to have a compound slope. FIG. 4 shows a lower filtration barrier surface 75 formed by a lower filtration barrier section 74 of the filtration barrier 70. The lower filtration barrier surface 75 is proximal to the ground surface 93 and would be the first surface to encounter rising levels of water as runoff water pools in front of the filtration barrier 70. The lower filtration barrier surface 75 extends upwards over the downstream ground surface area 95 so as to form a first slope angle 65. The slope angle is differentiated from tilt angle in that a slope angle, as used herein, describes the angle that a barrier surface makes with the vertical plane tangential to a point along the spanning path at which the slope angle is determined. The slope angle is herein determined along a path on the surface orthogonal to the spanning path, one example of a spanning path 98 is shown in FIG. 4. Thus, the slope angle may vary as a function of the catenary of the geo-fabric sheet 50 as it is suspended between support assemblies 20. In general, a slope angle of a portion of the geo-fabric sheet 50 is approximately equal to the tilt angle of a corresponding support structure, that tilt angle adjusted for catenary factors such as excess fabric length and fabric loading.

FIG. 4 additionally shows an upper filtration barrier surface 73 disposed upon the upper filtration barrier section 72 extending upwards over the downstream ground surface area 95 so as to form a second slope angle 66. FIG. 4 further shows a ground skirt 54 attached to the geo-fabric sheet 50 at the lower filtration barrier section 74. In this embodiment, the ground skirt 54 is disposed along the ground surface 93 in the upstream ground surface area 94 proximal to the spanning path 98.

FIG. 4 shows the first slope angle 65 of the lower filtration barrier surface 75 as including a slope angle between 0 degrees and 45 degrees. The second slope angle 66 of the upper filtration barrier surface 73 is shown as including a slope angle of between 15 degrees and 65 degrees. As stated above, the filtration barrier surface 71 has a compound slope. The term 'compound slope' herein is defined to mean a sloping surface having, in a vertical cross-section of the surface, at least two regions of the surface having different slope angles. Where, in a vertical cross-section of such a surface, the lowest region of the surface has the steepest slope angle and where each subsequent region of the surface has a slope angle that is shallower than any lower region of the surface and that is steeper than any higher region, but no region of the surface has a negative slope angle, then that surface shall be defined as having a falling, non-negative compound slope. Thus, for each embodiment of the invention shown in FIGS. 2–5 and 7, the filtration barrier surface 71 has a falling, non-negative compound slope.

Figure 5:
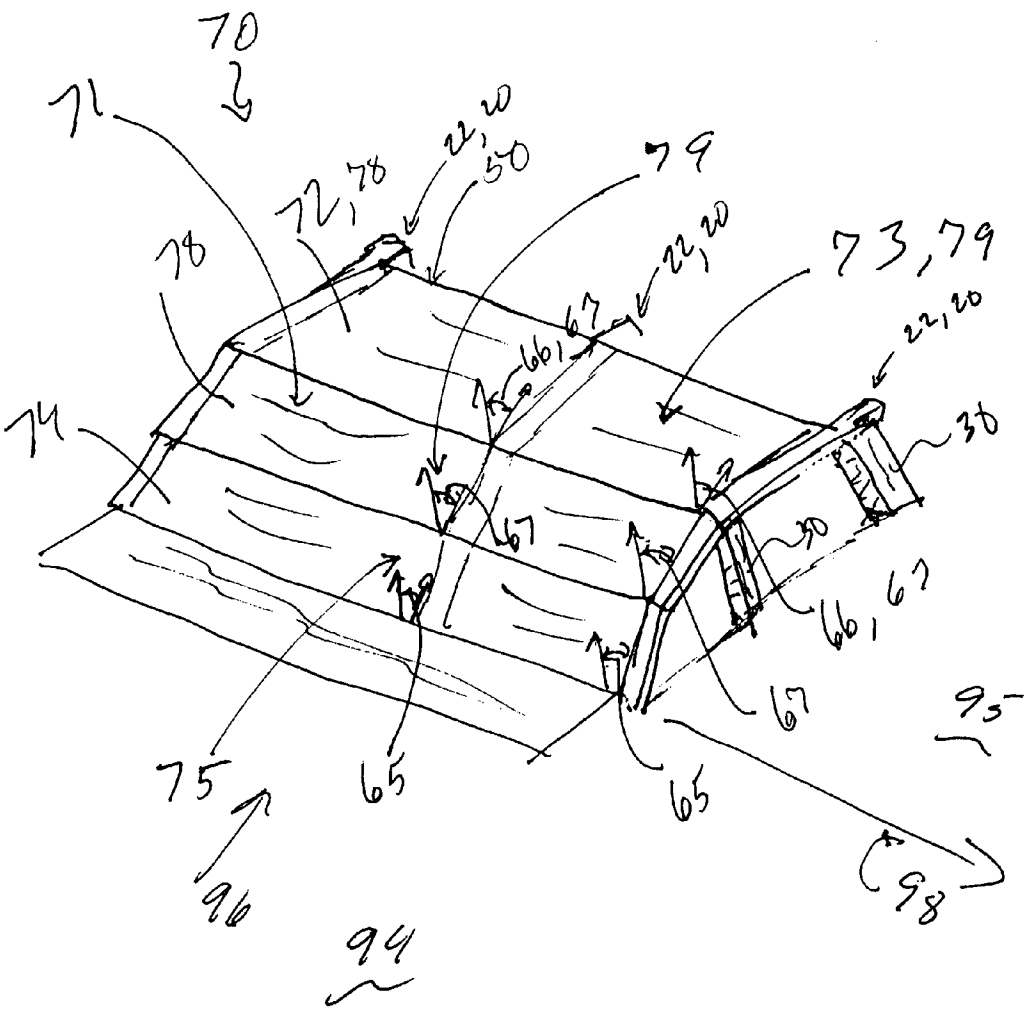
FIG. 5 is an oblique view of the embodiment of the invention of FIG. 3.

Referring now to FIG. 5, including a filtration barrier 70 having multiple compound slopes is shown installed upon the ground surface 93 along the spanning path 98. A geo-fabric sheet 50 is affixed to a support frame 22 so as to form a lower filtration barrier section 74 and first and second intermediate filtration barrier sections 78. The second intermediate filtration barrier section 78 is most distal to the lower filtration barrier section 74 and includes an upper filtration barrier section 72. The lower filtration barrier section 74 includes a lower filtration barrier surface 75 extending along the spanning path and extending upwards over the downstream ground surface area 95. Sequentially adjacent is a first intermediate filtration barrier surface 79 which is disposed on the first intermediate filtration barrier section 78 in a like manner. A final upper filtration barrier surface 73 is disposed upon the upper filtration barrier section 72. Each filtration barrier surface forms a slope angle such that the lower first slope angle 65 formed by the lower filtration barrier surface is steeper than the subsequent intermediate slope angles 67. Each intermediate slope angle 67 is steeper than each subsequent intermediate slope angle 67. As in the embodiment of FIG. 4, the embodiment of FIG. 5 shows a lower slope angle 65 including a slope angle of between 0 and 45 degrees. Alternatively, this embodiment shows each intermediate slope angle 67 including a slope angle between 5 degrees and 90 degrees.

Figure 6:
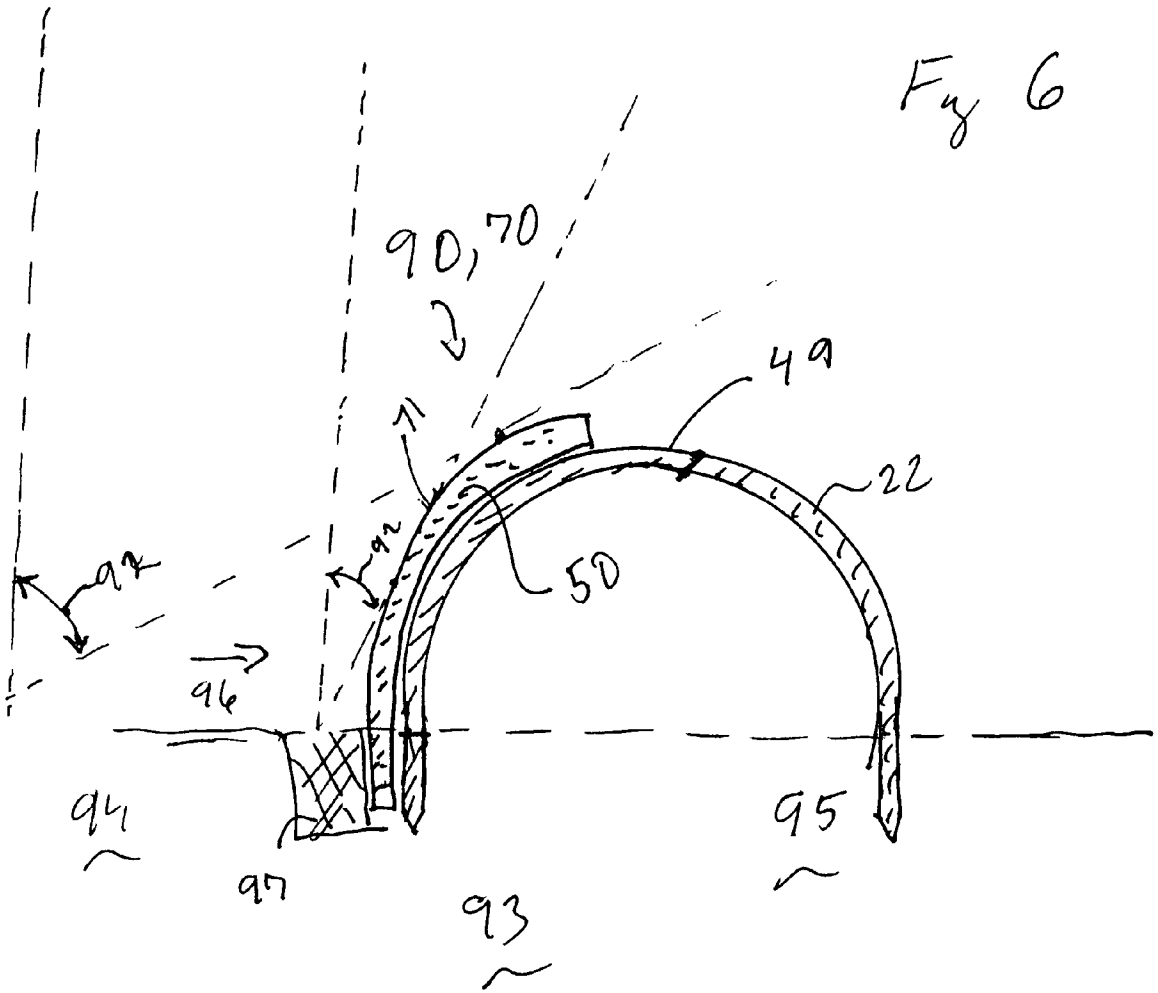
FIG. 6 is a cross-sectional perspective view of an alternative embodiment of a modified angled silt fence adapted to form a barrier having a convex slope.

An upwardly convex barrier 90 is shown in FIG. 6 as an alternative embodiment of the present invention. The upwardly convex barrier 90 includes a filtration barrier 70 having a geo-fabric sheet 50 attached to a plurality of support frame 22. A support frame 22 is shown having a resilient flexible strut 49 installed in a curved manner. In alternate embodiments the support frame 22 includes a curved rigid strut or includes a curved articulated assembly. Referring again to the embodiment of FIG. 6, a geo-fabric sheet 50 is attached to the resilient flexible strut 49 so as to form an upwardly convex barrier 90 having varying tangential slope angles 92 of between 0 degrees and 90 degrees. In this embodiment of the invention, the steepest tangential slope angles are at such points of the curved surface as are most proximate to the spanning path along the ground surface 93.

Referring now to the embodiment of the invention shown in FIG. 7, a filtration barrier 70 of FIG. 4 is shown installed upon the ground surface 93 along the spanning path 98 and impeding a water flow 96. The geo-fabric sheet 50 is shown attached to the support assemblies 20 so as to form a filtration barrier 70 having a filtration barrier surface 71 adapted to filter non-colloidal silt from the water flow 96. The filtration barrier 70 is shown including a lower filtration barrier section 74 having lower filtration barrier surface 75 and extending from the ground surface 93 upwards above the downstream ground surface area 95 at a first slope angle 65. The filtration barrier 70 is shown further including a upper filtration barrier section 72 having upper filtration barrier surface 73 and extending from the lower filtration barrier section 74 further upwards above the downstream ground surface area at a second slope angle 66, wherein the first slope angle 65 is steeper than the second slope angle 66.

An accumulation of ponded water flow is shown having a height of water 100 sufficient to submerge the lower filtration barrier surface 75 and at least a portion of the upper filtration barrier surface 73. Water flows through the lower filtration barrier surface 75 such that non-colloidal silt 99 is filtered from the water flow 96. The first slope angle 65 of the lower filtration barrier surface 75 is sufficiently steep so as to cause a portion of the non-colloidal silt 99 filtered by the lower filtration barrier surface 75 to fall by gravity away from the lower filtration barrier surface 75.

Although a greater height of water 100 produces greater static head and, thus, a greater flow of water through the lower filtration barrier surface 75, a greater height of water 100 produces significant lateral forces that can substantially reduce the stability of the filtration barrier 70. It is desirable to minimize the maximum height of water 100 to which the filtration barrier 70 is exposed. For a given amount of deposited water and water deposition rate, the maximum height of water 100 to which the filtration barrier 70 is exposed is determined by the flow rate through the filtration barrier surface 71. In a standard vertical silt fence assembly, a geo-textile sheet 50 formed from a geo-textile 51 has a nominal water flow capacity proportional to the height of water 100 of an intercepted water flow 96. In the embodiment of the present invention shown in FIG. 7, the second slope angle 62 is sufficiently shallow so as to expose the intercepted water flow to a sufficiently greater amount of filtration barrier surface 71 so as to increase the water flow capacity of geo-fabric sheet 50 as proportional to the height of water 100 of an intercepted water flow 96. Additionally, the second slope angle 66 is sufficiently steep so as to cause a portion of the non-colloidal silt 99 filtered by the upper filtration barrier surface 73 to fall away from the upper filtration barrier surface 73. This shedding of filtered sediment 99 reduces the mechanical loading of the support assemblies 20 and the filtration barrier surface 71. This novel modification of the slope of the surface of the silt fence provides a silt fence assembly that increases the percentage of geo-fabric sheet 50 surface area used for filtering while maintaining effective silt shedding characteristics of the filtration barrier surface 71. FIG. 7 illustrates the functioning of an embodiment of the present invention including a filtration barrier surface 71 having a singly compounded slope. Other embodiments of the present invention presented above employ multiple compound barrier slopes and would function in a similar manner. In particular, an upwardly convex barrier 90 may be curved so as to maximize the water flow capacity of a geo-fabric sheet 50 formed from geo-fabric 51 as relative to the nominal water flow capacity for a given height of water 100.

In the embodiment of the present invention shown in FIGS. 1–7, the geo-fabric sheet 50 is formed from geo-fabric 51. The present invention contemplates geo-fabric sheets 50 formed from geo-membranes and geo-grids as well. In the embodiment of the present invention shown in FIG. 7, the filtration characteristics of the geo-textile 51 are uniform across the height of the filtration barrier surface 71. However, it would be obvious to one skilled in the art that variation of the degree of porosity for geo-fabric sheets can be combined with barriers having multiple filtration barrier slopes or convexly curving surfaces to provide even greater improvements of water flow capacity through the filtration barrier surfaces.

Thus, although there have been described particular embodiments of the present invention of a new and useful Modified Angled Silt Fence, it is not intended that such references be construed as limitations upon the scope of this invention except as set forth in the following claims.

What is claimed is:

1. A filtration barrier for filtering waterborne sediment comprising:

a rear strut, the rear strut having an rear strut upper end and a rear strut lower end, the rear strut lower end adapted for attachment to a ground surface;

an articulated front support, the front support comprising an upper front strut and a lower front strut, the upper front strut having an upper front strut upper end and an upper front strut lower end, the lower front strut having a lower front strut upper end and a lower front strut lower end, wherein the upper front strut upper end is flexibly attached to the rear strut upper end, wherein the upper front strut lower end is flexibly attached to the lower front strut upper end, and wherein the lower front strut lower end is adapted for attachment to a ground surface, and a geo-fabric sheet attached to the articulated front support, the geo-fabric sheet adapted for filtration of non-colloidal slit from a flow of water.

2. The filtration barrier support of claim 1, wherein the upper front strut upper end is pivotally attached to the rear strut upper end, and wherein the upper front strut lower end is pivotally attached to the lower front strut upper end.

3. The filtration barrier support of claim 1, the articulated front support further comprising:

a temporary reinforcing assembly, the temporary reinforcing assembly removably attached to the upper front strut lower end and to the lower front strut upper end, and wherein the temporary reinforcing assembly is so affixed as to maintain linear alignment of the lower front strut and the upper front strut during installation of the lower front strut lower end into the ground surface.

4. The filtration barrier support of claim 1 further comprising:

at least one transverse strut, the transverse strut having a transverse strut front end and transverse strut rear end, the transverse strut rear end attachable to the rear strut, the transverse strut front end attachable to the articulated front support.

5. The filtration barrier support of claim 1 wherein the lower front strut is further adapted for installation at an interval point along a spanning path across a ground surface, the spanning path dividing the ground surface into an upstream area and a downstream area, the lower front strut, when so installed, extending away from the upstream area so as to form a first tilt angle and the upper front strut further extending away from the upstream area so as to form a second tilt angle, and wherein the rear strut is further adapted for installation to the ground surface at a point in the downstream area and, when so installed, extending toward the upstream area, and wherein the first tilt angle is steeper than the second tilt angle.

6. The filtration barrier support of claim 5, the first tilt angle comprising a tilt angle of between 0 degrees and 45 degrees and the second tilt angle comprising a tilt angle of between 15 degrees and 65 degrees.

7. The filtration barrier support of claim 6, wherein the sheet is further adapted for attachment to at least one additional filtration barrier support, each of the additional filtration barrier supports equivalent in structure to the filtration barrier support, and each at least one additional filtration barrier support adapted for installation at an interval point along the spanning path, and wherein when the filtration barrier support and additional filtration barrier supports are installed at interval points along a spanning path and the sheet is attached to the filtration barrier support and additional filtration barrier supports, the sheet forms a filtration barrier having a lower filtration barrier section sloped at the first tilt angle and an upper filtration barrier section sloped at the second tilt angle.

8. The filtration barrier support of claim 6, the geo-fabric comprising a geo-textile sheet.

9. A filtration barrier for filtering waterborne sediment, the filtration barrier comprising:

an articulated front support, the articulated front support comprising a plurality of front struts, the plurality of front struts assembled in an articulated, linear configuration, wherein each front strut is disposed adjacent to at least one other front strut, and wherein each the front strut is flexibly attached to each the adjacent front strut, the plurality of struts comprising:

a lower front strut, the lower front strut having a lower front strut lower end, wherein the lower front strut lower end is adapted for attachment to a ground surface; and at least one intermediate front strut; and at least one rear strut, each the at least one rear strut having an rear strut a rear strut lower end, each the rear strut lower end adapted for attachment to a ground surface, wherein each the at least one rear strut is flexibly attached to a front strut, a geo-fabric sheet attached to the articulated front support, the geo-fabric sheet adapted for filtration of non-colloidal slit from a flow of water.

10. The filtration barrier support of claim 9 wherein the lower front strut is further adapted for installation at an interval point along a spanning path across a ground surface, the spanning path dividing the ground surface into an upstream area and a downstream area, the lower front strut, when so installed, extending away from the upstream area so as to form a first tilt angle and each the intermediate front strut sequentially further extending away from the upstream area so as to form a plurality of intermediate tilt angles, and wherein for each at least one rear strut, the rear strut is further adapted for installation to the ground surface at a point in the downstream area and, when so installed, extending toward the upstream area, and wherein the lower tilt angle is steeper than each the intermediate tilt angles, and each the intermediate tilt angle is steeper than each subsequent intermediate tilt angle.

11. The filtration barrier support of claim 10, the lower tilt angle comprising a tilt angle of between 0 degrees and 45 degrees, and each the intermediate tilt angle comprising a tilt angle of between 5 degrees and 90 degrees.

12. A filtration barrier comprising:

a plurality of filtration barrier supports, each the filtration barrier supports comprising a rear strut, the rear strut having an rear strut upper end and a rear strut lower end, the rear strut lower end adapted for attachment to a ground surface; and an articulated front support, the front support comprising an upper front strut and a lower front strut, the upper front strut having an upper front strut upper end and an upper front strut lower end, the lower front strut having a lower front strut upper end and a lower front strut lower end, wherein the upper front strut upper end is flexibly attached to the rear strut upper end, wherein the upper front strut lower end is flexibly attached to the lower front strut upper end, and wherein the lower front strut lower end is adapted for attachment to a ground surface; and a sheet, the sheet adapted for filtration of waterborne sediment, wherein the sheet is attached to the plurality of filtration barrier supports, each of the articulated front supports of each the filtration barrier support attached to the sheet at intervals along the sheet.

13. The filtration barrier of claim 12, wherein for each the filtration barrier supports, the upper front strut upper end is pivotally attached to the rear strut upper end, and wherein the upper front strut lower end is pivotally attached to the lower front strut upper end.

14. The filtration barrier of claim 13, wherein for each filtration barrier support, the first tilt angle comprising a tilt angle of between 0 degrees and 45 degrees, and the second tilt angle comprising a tilt angle of between 15 degrees and 65 degrees.

15. The filtration barrier of claim 14, wherein when the plurality of filtration barrier supports are installed at interval points along the spanning path, the sheet, at each the barrier support, forms a filtration barrier having a lower filtration barrier section sloped at the first tilt angle and an upper filtration barrier section sloped at the second tilt angle.

16. The filtration barrier of claim 12, the geo-fabric sheet further comprising a geo-textile.

17. The filtration barrier of claim 12, wherein for each filtration barrier support, the lower front strut is further adapted for installation at an interval point along a spanning path across a ground surface, the spanning path dividing the ground surface into an upstream area and a downstream area, the lower front strut, when so installed, extending away from the upstream area so as to form a first tilt angle and the upper front strut further extending away from the upstream area so as to form a second tilt angle, and wherein the rear strut is further adapted for installation to the ground surface at a point in the downstream area and, when so installed, extending toward the upstream area, and wherein the first tilt angle is steeper than the second tilt angle.

18. The filtration barrier of claim 17, wherein for each filtration barrier support, the first tilt angle is substantially equivalent to the first tilt angles of the plurality of filtration barrier supports, and wherein for each filtration barrier support, the second tilt angle is substantially equivalent to the second tilt angles of the plurality of filtration barrier supports.

19. The filtration barrier of claim 18, the sheet further comprising a ground skirt, the ground skirt attached to the lower filtration barrier section.

20. The filtration barrier support of claim 12, the sheet comprising a geo-fabric sheet.

21. The filtration barrier of claim 20, the geo-textile further comprising a woven geo-textile.

22. The filtration barrier of claim 21, the ground skirt further comprising a geo-fabric sheet.

23. The filtration barrier of claim 22, the first slope angle comprising a slope angle of between 0 degrees and 45 degrees, and the second slope angle comprising a slope angle of between 16 degrees and 65 degrees.

24. The filtration barrier of claim 22, the first slope angle varying between 0 degrees and 45 degrees at different points along the spanning path, and the second slope angle varying between 15 degrees and 65 degrees at different points along the spanning path.

25. A filtration barrier comprising:

a plurality of support frames, each the support frame adapted for installation upon a ground surface at interval points along a spanning path, the spanning path being transverse to gravity-directed water flow, and the spanning path defining an upstream ground surface area and a downstream ground surface area; and a geo-textile sheet, the geo-textile sheet affixed to each the support frame, wherein when the plurality of support frames is installed at interval points along the spanning path, the geo-textile sheet forms a filtration barrier surface extending along the spanning path such that the filtration barrier surface impedes the water flow, the filtration barrier surface comprising an upper filtration barrier surface and a lower filtration barrier surface such that the lower filtration barrier surface and the upper filtration barrier surface extends adjacently along the spanning path, the lower filtration surface proximal to the ground surface and the upper filtration barrier surface distal to the ground surface, the lower filtration barrier surface extends over the downstream ground surface area at a first slope angle, the first slope angle orthogonal to the spanning path, the upper filtration barrier surface further extends over the downstream ground surface area at a second slope angle, and the first slope angle is steeper than the second slope angle.

26. A filtration barrier comprising:

a plurality of support frames, each of the support frames adapted for installation upon a ground surface at interval points along a spanning path, the spanning path being transverse to gravity-directed water flow, and the spanning path defining an upstream ground surface area and a downstream ground surface area; and a geo-textile sheet, the geo-textile sheet affixed to at least two the support frames, wherein when the plurality of support frames is installed at interval points along the spanning path, the geo-textile sheet forms a filtration barrier surface extending along the spanning path such that the filtration barrier surface impedes the water flow, the filtration barrier surface comprising an upper a lower filtration barrier surface and further comprising at least one intermediate filtration barrier surface such that:

the lower filtration barrier surface extends along the spanning path, the lower filtration surface proximal to the ground surface, each intermediate filtration barrier surface extends along the spanning path in a sequential, articulated panel configuration, each intermediate filtration barrier surface more distal to the ground surface than each sequentially previous intermediate filtration barrier surfaces, the lower filtration barrier surface extends over the downstream ground surface area at a first slope angle, the first slope angle orthogonal to the spanning path, each intermediate filtration barrier surface sequentially further extends over the downstream ground surface area so as to form a plurality of slope angles, and the first slope angle is steeper than each the intermediate slope angles, and each intermediate slope angle is steeper than each subsequent intermediate slope angle.

27. The filtration barrier of claim 26, the lower slope angle comprising a slope angle of between 0 degrees and 45 degrees, and each the intermediate slope angle comprising a slope angle of between 5 degrees and 90 degrees.

28. The filtration barrier of claim 26, the first slope angle varying between 0 degrees and 45 degrees at different points along the spanning path, and each the intermediate slope angle varying between 15 degrees and 65 degrees at different points along the spanning path.

29. The filtration barrier of claim 28, wherein when the filtration barrier surface intercepts a water flow of sufficient height that the lower filtration barrier surface and at least a portion of the upper filtration barrier surface are submerged beneath the surface of the water flow, the second slope angle is sufficiently steep so as to cause a portion of the non-colloidal silt filtered by the upper filtration barrier surface to fall away from the upper filtration barrier surface.

30. The filtration barrier of claim 28, the geo-textile further comprising a woven geo-textile.

31. The filtration barrier of claim 28, the first slope angle comprising a slope angle of between 0 degrees and 45 degrees, and the second slope angle comprising a slope angle of between 15 degrees and 65 degrees.

32. The filtration barrier of claim 28, the first slope angle varying between 0 degrees and 45 degrees at different points along the spanning path, and the second slope angle varying between 15 degrees and 65 degrees at different points along the spanning path.

33. A filtration barrier assembly comprising:

a support assembly installed upon a ground surface along a spanning path, the spanning path being transverse to gravity-directed water flow, and the spanning path defining an upstream ground surface area and a downstream ground surface area; and a geo-textile sheet attached to the support assembly so as to form a filtration barrier surface for impeding the water flow, the filtration barrier surface adapted to filter non-colloidal silt from the water flow, the geo-fabric sheet having a nominal water flow capacity proportional to the height of an intercepted water flow, the filtration barrier surface comprising an lower filtration barrier surface, the lower filtration barrier surface extending from the ground surface upwards above the downstream ground surface area at a first slope angle, and the filtration barrier surface further comprising an upper filtration barrier surface, the upper filtration barrier surface extending from the lower filtration barrier surface further upwards above the downstream ground surface area at a second slope angle, wherein the first slope angle is steeper than the second slope angle, wherein when the filtration barrier surface intercepts a water flow of sufficient height that the lower filtration barrier surface and at least a portion of the upper filtration barrier surface are submerged beneath the surface of the water flow, the first slope angle is sufficiently steep so as to cause a portion of the non-colloidal silt filtered by the lower filtration barrier surface to fall away from the lower filtration barrier surface, and the second slope angle is sufficiently shallow so as to expose the intercepted water flow to a sufficiently greater area of the filtration barrier surface so as to increase the water flow capacity of the geo-textile sheet as proportional to the height of the intercepted water flow.

34. A filtration barrier assembly comprising:

at least two support assemblies adapted for installation, each at interval points, along a spanning path across a ground surface, the spanning path dividing the ground surface into an upstream area and a downstream area, each the support assembly comprising a rear strut, the rear strut having an rear strut upper end and a rear strut lower end, the rear strut lower end adapted for attachment to a ground surface; and an articulated front support, the front support comprising an upper front strut and a lower front strut, the upper front strut having an upper front strut upper end and an upper front strut lower end, the lower front strut having a lower front strut upper end and a lower front strut lower end, wherein the upper front strut upper end is hingedly attached to the rear strut upper end, wherein the upper front strut lower end is hingedly attached to the lower front strut upper end, and wherein the lower front strut lower end is adapted for attachment to a ground surface; and a woven geo-textile sheet, the woven geo-textile sheet adapted for filtration of waterborne sediment, the woven geo-textile sheet attached to a plurality of the articulated front supports, the woven geo-textile sheet further comprising a ground skirt, the ground skirt attached to the lower filtration barrier section, wherein each support assembly may be installed at an interval point along the spanning path such that:

the lower front strut is attached to the ground surface at the interval point such that the lower front strut extends away from the upstream area so as to form a first tilt angle, the first tilt angle comprising a tilt angle of between 90 degrees and 45 degrees, the upper front strut further extends away from the upstream area so as to form a second tilt angle, the second tilt angle comprising a tilt angle of between 75 degrees and 25 degrees the first tilt angle is steeper than the second tilt angle, and the rear struts is attached to the ground surface at a point in the downstream area and extended toward the upstream area so as to provide bracing support to the articulated front support, and wherein the geo-textile sheet is attached to the articulated front supports so as to form a filtration barrier having a lower filtration barrier section sloped at the first tilt angle and an upper filtration barrier section sloped at the second tilt angle.

* * * * *